US008610526B2

(12) United States Patent
Saito et al.

(10) Patent No.: US 8,610,526 B2
(45) Date of Patent: Dec. 17, 2013

(54) RESIN COMPOSITION, ELECTRONIC COMPONENT USING THE SAME AND PRODUCTION METHOD THEREFOR

(75) Inventors: Koichi Saito, Tsurugashima (JP); Yukio Nagashima, Tsurugashima (JP); Kunio Sasamori, Tsurugashima (JP)

(73) Assignee: TOKO, Inc., Saitama (JP)

( * ) Notice: Subject to any disclaimer, the term of this patent is extended or adjusted under 35 U.S.C. 154(b) by 0 days.

(21) Appl. No.: 13/571,015

(22) Filed: Aug. 9, 2012

(65) Prior Publication Data

US 2012/0299688 A1 Nov. 29, 2012

Related U.S. Application Data

(62) Division of application No. 12/640,792, filed on Dec. 17, 2009.

(30) Foreign Application Priority Data

Dec. 19, 2008 (JP) ..... 2008-323399

(51) Int. Cl.

| | |
|---|---|
| ***H01F 27/02*** | (2006.01) |
| ***H01F 27/24*** | (2006.01) |
| ***H01F 27/30*** | (2006.01) |
| ***H01F 1/00*** | (2006.01) |
| ***H01C 17/06*** | (2006.01) |

(52) U.S. Cl.

USPC ..... 336/83; 336/221; 336/205; 427/99.4; 252/62.53

(58) Field of Classification Search

USPC ..... 336/83, 221, 233, 205; 427/99.4, 116; 252/62.53, 62.51 R, 62.54; 29/605, 606

See application file for complete search history.

(56) References Cited

U.S. PATENT DOCUMENTS

| | | | | |
|---|---|---|---|---|
| 3,914,467 | A | 10/1975 | Akao et al. | |
| 7,209,022 | B2 | 4/2007 | Kuroiwa et al. | |
| 7,310,871 | B2 * | 12/2007 | Kuroiwa et al. | 29/605 |
| 2007/0142600 | A1 * | 6/2007 | Green et al. | 528/44 |

FOREIGN PATENT DOCUMENTS

| | | |
|---|---|---|
| JP | 62-011825 | 1/1987 |
| JP | 09-162001 | 6/1997 |
| JP | 10-055912 | 2/1998 |
| JP | 10-055912 A * | 2/1998 |

(Continued)

OTHER PUBLICATIONS

Science Lab "Material Safety Data Sheet: Strearic acid MSDS" <http://www.sciencelab.com/msds.php?msdsId=9927609> accessed by examiner on Jul. 18, 2012.

(Continued)

*Primary Examiner* — Alexander Talpalatski
*Assistant Examiner* — Mangtin Lian
(74) *Attorney, Agent, or Firm* — Cozen O'Connor

(57) ABSTRACT

Disclosed is a resin composition, which comprises a thermosetting resin contained therein in an amount of 40 volume % or more, and a wax contained therein in an amount of 5 to 30 volume %, wherein: the thermosetting resin exists in liquid form at room temperature; and the wax exists in powder form at room temperature and has a melting point of 70 to 150° C., and wherein the resin composition has a viscosity of 50000 to 150000 mPa·s as measured at room temperature.

2 Claims, 1 Drawing Sheet

(56) References Cited

FOREIGN PATENT DOCUMENTS

| | | |
|---|---|---|
| JP | 2001-100223 | 4/2001 |
| JP | 2005-210055 | 8/2005 |
| JP | 2006-054394 | 2/2006 |
| JP | 2007-067081 | 3/2007 |
| JP | 2007-173576 | 7/2007 |
| JP | 2007-207928 | 8/2007 |
| JP | 2008-205245 | 9/2008 |

OTHER PUBLICATIONS

English machine translation of JP 10-055912, http://www.jpo.go.jp/ accessed by examiner on Jul. 18, 2012.

* cited by examiner

RESIN COMPOSITION, ELECTRONIC COMPONENT USING THE SAME AND PRODUCTION METHOD THEREFOR

CROSS REFERENCE TO RELATED APPLICATIONS

This application is a divisional of U.S. patent application Ser. No. 12/640,792, filed with the U.S. Patent and Trademark Office on Dec. 17, 2009, which claims priority to JP 2008-323399, filed Dec. 19, 2008, both of which are hereby incorporated by reference in their entireties.

BACKGROUND OF THE INVENTION

1. Field of the Invention

The present invention relates to a resin composition, and more particularly to a resin composition best suited for application with a dispenser. The present invention also relates to an electronic component using the resin composition.

2. Description of the Background Art

Heretofore, there has been known a coil component configured such that a winding is attached to a drum core having a winding core portion and a pair of flange portions, and the resulting winding area is covered by a resin composition containing a thermosetting (thermally curable) resin. For example, JP 2007-67081A discloses a coil component in which a winding is wound around a drum core, and the resulting winding-wound area is covered by a resin composition comprising a mixture of a magnetic powder and a resin. A closed magnetic circuit-type coil component can be produced using such a resin composition.

Generally, a conventional resin composition for use in such a coil component is prepared to allow a viscosity thereof at room temperature to fall within a range of 50000 to 150000 mPa·s. This resin composition is injected onto several areas between the upper and lower flange portions of the drum core using a dispenser to cover the winding areas, and cured. As a prerequisite to forming a closed magnetic circuit, it is essential to seamlessly apply the resin composition onto a surface of the winding wound around the drum core so as to keep the winding from being exposed. In order to seamlessly apply the resin composition, it is necessary to inject the resin composition between the upper and lower flange portions of the drum core in a large amount, or increase the number of injection areas. Specifically, in a coil component having a size of 3 mm length×3 mm width×1 mm height, it is necessary to inject the resin composition onto 8 to 10 areas. This leads to deterioration in operating efficiency and an increase in injection amount of the resin composition.

A thermosetting resin contained in the resin composition injected into the drum core is thermally expanded when it is thermally cured or is subjected to a thermal shock test. Thus, if the resin composition is injected in a large amount, an expansion/shrinkage stress of the thermosetting resin caused by temperature changes will be imposed on the flange portions of the drum core. This is likely to cause the occurrence of crack in the drum core. Moreover, such a large injection amount of the resin composition leads to an increase in cost.

The conventional resin composition is apt to stay on an injected area due to its high viscosity and low wettability. Thus, if an injection amount of the resin composition or the number of injection areas is reduced to suppress the expansion/shrinkage stress of the thermosetting resin, it becomes difficult to seamlessly apply the resin composition onto the surface of the winding. The exposure of the winding causes not only deterioration in appearance, but also magnetic flux leakage which precludes the formation of a closed magnetic circuit to result in defective quality.

As measures against the above problems, there has been proposed a technique intended to allow a resin composition to be applied to the entire outer surface of a winding by imparting excellent fluidity to the resin composition, wherein the resin composition is prepared to have a viscosity of 10000 mPa·s or less as measured at room temperature, as disclosed in JP 3704768. However, this resin composition has poor handleability due to the significantly low viscosity at room temperature. Thus, during application with a dispenser, the resin composition is liable to attach onto a power supply terminal and a drum core.

SUMMARY OF THE INVENTION

It is an object of the present invention to provide a resin composition capable of, during application with a dispenser, achieving an adequate covering effect in a relatively small application amount, while ensuring excellent handleability.

It is another object of the present invention to provide an electronic component using the resin composition, and a production method for the electronic component.

In order to achieve the above objects, the present invention provides a resin composition which comprises a thermosetting resin contained therein in an amount of 40 volume % or more, and a wax contained therein in an amount of 5 to 30 volume %, wherein: the thermosetting resin exists in liquid form at room temperature, and the wax exists in powder form at room temperature and has a melting point of 70 to 150° C., and wherein the resin composition has a viscosity of 50000 to 150000 mPa·s as measured at room temperature.

The resin composition of the present invention is a mixture comprising a thermosetting resin which exists in liquid form at room temperature, and a wax which exists in powder form at room temperature, and optionally including at least one of a magnetic powder and an inorganic filler. The resin composition is prepared such that a viscosity thereof at room temperature is set in the range of 50000 to 150000 mPa·s, preferably 60000 to 80000 mPa·s, according to intended use conditions. If the viscosity of the resin composition at room temperature is less than 50000 mPa·s, operating efficiency (handleability) will deteriorate. Therefore, the resin composition is prepared to have a viscosity of 50000 mPa·s or more. If the viscosity is greater than 150000 mPa·s, the application with a dispenser becomes difficult. Therefore, the resin composition is prepared to have a viscosity of 150000 mPa·s or less.

A content of the thermosetting resin in the resin composition may be appropriately determined within the range of 40 volume % or more, preferably 50 volume % or more. The thermosetting resin may be any type as long as it exists in liquid form at room temperature. Specifically, the thermosetting resin may be appropriately selected from the group consisting of an epoxy resin, a phenolic resin, a silicon resin, and a material containing one or more thereof.

A content of the wax in the resin composition may be appropriately determined within the range of 5 to 30 volume %, preferably 20 to 30 volume %. If the wax content is less than 5 volume %, the resin composition cannot have a sufficient wettability during thermal curing to cause difficulty in adequately covering an electronic component. The wax may be any type as long as it exists in powder form at room temperature and has a melting point of 70 to 150° C. Specifically, the wax may be one or more selected from various types of waxes including: a fatty acid ester-based wax, such as a montanic acid-based wax; and a hydrocarbon-based wax, such as a paraffin wax or a carnauba wax.

A total content of at least one of the magnetic powder and the inorganic filler in the resin composition may be appropriately determined within the range of 5 to 50 volume %. The magnetic powder may be any type. Specifically, the magnetic powder may be one or more selected from various magnetic materials including a ferrite powder, an iron powder, a permalloy powder and a silicon steel powder. The magnet powder is not essential to the resin composition, but may be added according to need.

The inorganic filler is not limited to a specific type. For example, the inorganic filler includes crushed fused silica, crushed crystalline silica, spherical silica, silicon carbide, silicon nitride, boron nitride, calcium carbonate, magnesium carbonate, barium sulfate, calcium sulfate, mica, talc, clay, aluminum oxide, magnesium oxide, zirconium oxide, aluminum hydroxide, magnesium hydroxide, calcium silicate, aluminum silicate, lithium aluminum silicate, zirconium silicate, barium titanate, glass bead, glass fiber, carbon fiber, and molybdenum disulfide. These materials may be used as the inorganic filler independently or in any combination. The inorganic filler is not essential to the resin composition, but may be added according to need.

The resin composition of the present invention is prepared by mixing the above raw materials, and the obtained mixture is applied to a given area of an electronic component, at room temperature. After the application at room temperature, the resin composition is thermally cured by heating at a temperature of 100 to 200° C. A temperature of the heating for thermally curing the resin composition may be appropriately determined depending on a curing temperature of the thermosetting resin.

The resin composition of the present invention may be used as an adhesive or a shielding material for electronic components. Specifically, the resin composition may be used for various electronic components, such as a power inductor, a common-mode choke coil, an inverter transformer, an antenna, a noise filter, a bead inductor, a variable coil, a balun transformer, a magnetic sensor, a sound producing component (buzzer, speaker, etc.), a power supply adapter, and a switch.

As above, the resin composition of the present invention contains a wax in an amount of 5 to 30 volume %, wherein the wax exists in powder form at room temperature and has a melting point of 70 to 150° C. Thus, in a stage where the resin composition is prepared at room temperature, the wax exists in powder form to provide a relatively high viscosity to the resin composition. However, in a stage where the resin composition is thermally cured, the wax is melted to provide a relatively low viscosity to the resin composition, because the melting point of the wax is less than the curing temperature of the thermosetting resin.

Therefore, the resin composition of the present invention exhibits excellent handleability, because it maintains an appropriate viscosity during application with a dispenser. Further, during thermal curing, the viscosity is lowered to provide a high fluidity and excellent wettability. Thus, the resin composition of the present invention can achieve an adequate covering effect even if an application amount or the number of injection areas is set to a relatively small value. In addition, during thermal curing, the resin composition exhibits a relatively high fluidity to reduce an expansion/shrinkage stress thereof to be imposed on an electronic component

DESCRIPTION OF THE PREFERRED EMBODIMENTS

Figure 1A:
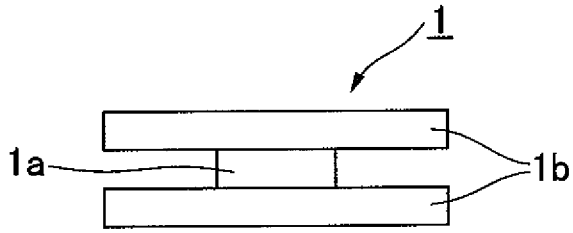
FIGS. 1(*a*) to 1(*d*) are schematic diagrams showing a production method for a coil component, according to one embodiment of the present invention.
Figure 1B:
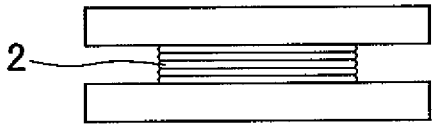
Figure 1C:
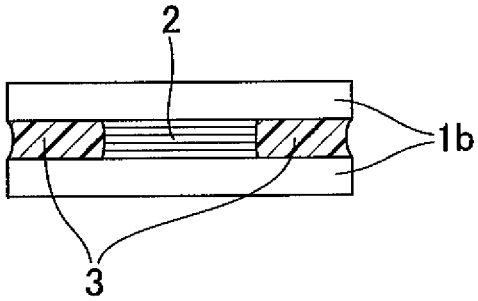
Figure 1D:
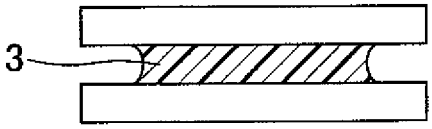

With reference to drawings, the present invention will be described based on an embodiment thereof. FIGS. 1(*a*) to 1(*d*) are schematic diagrams showing a production method for a coil component, according to one embodiment of the present invention. Specifically, FIG. 1(*a*), FIG. 1(*b*), FIG. 1(*c*) and FIG. 1(*d*) show an initial state, a state just after a winding is attached to a drum core, a state just after a resin composition is injected, and a state after the resin composition is thermally cured.

Firstly, a drum core and a resin composition used in this embodiment will be described below. As shown in FIG. 1(*a*), the drum core 1 has a winding core portion 1*a*, and a pair of flange portions 1*b* formed on respective opposite ends of the winding core portion 1*a*. In this embodiment, the drum core 1 is prepared to have a size of 3 mm length×3 mm width×1 mm height. The resin composition is prepared to have a viscosity of 80000 mPa·s as measured at room temperature, by adding 20 volume % of wax and 25 volume % of magnetic powder to an epoxy resin. In this embodiment, a montanic acid ester powder having a melting point of 80° C. is used as the wax, and a ferrite powder is used as the magnetic powder.

The coil-component production method according to this embodiment will be described below. As shown in FIG. 1(*b*), a winding 2 is wound around the drum core 1. As shown in FIG. 1(*c*), the resin composition 3 is injected onto the winding between the flange portions 1*b* using a dispenser. In this embodiment, the resin composition 3 is injected onto four areas at even intervals. Then, the resin composition 3 is thermally cured by heating at 150° C. During the heating, the resin composition injected onto the four areas covers the entire surface of the winding, as shown in FIG. 1(*d*). Specifically, the wax contained in the resin composition has a melting point less than a curing temperature of the resin. Thus, during the thermal curing, the wax is easily melted to spread over the surface of the winding. Accordingly, the entire resin composition will spread over the entire surface of the winding.

What is claimed is:

1. A coil component comprising:

a resin composition containing a thermosetting resin which exists in liquid form at room temperature, a wax which exists in powder form at room temperature and has a melting point of 70 to 150° C., and a magnetic powder, the resin composition being prepared by mixing the thermosetting resin, the wax and the magnetic powder at room temperature in such a manner that the thermosetting resin and the wax are contained in the resin composition, respectively, in an amount of 40 volume % or more and in an amount of 5 to 30 volume %, and the wax and the magnetic powder are contained in the resin composition in a total amount of 10 to 50 volume %, whereby the resin composition has a viscosity of 50000 to 150000 mPa·s as measured at room temperature; and a drum core to which a winding is attached;

wherein the resin composition is injected into a plurality of portions between an upper flange and a lower flange of the drum core at room temperature; and the resin composition injected into the plurality of portions of the drum core is thermally cured at a temperature greater than the melting point of the wax, thereby the wax in the resin composition is melted to provide lower viscosity to the resin composition so that the resin composition covers the entire surface of the winding.

2. A coil component, comprising:

a resin composition containing a thermosetting resin which exists in liquid form at room temperature, a wax which exists in powder form at room temperature and has a melting point of 70 to 150° C., a magnetic powder, and an inorganic filler, the resin composition being prepared by mixing the thermosetting resin, the wax, the magnetic powder and the inorganic filler at room temperature in such a manner that the thermosetting resin and the wax are contained in the resin composition, respectively, in an amount of 40 volume % or more and in an amount of 5 to 30 volume %, and the wax, the magnetic powder and the inorganic filler are contained in the resin composition in a total amount of 10 to 50 volume %, whereby the resin composition has a viscosity of 50000 to 150000 mPa·s as measured at room temperature; and a drum core to which a winding is attached;

wherein the resin composition is injected into a plurality of portions between an upper flange and a lower flange of the drum core at room temperature; and the resin composition injected into the plurality of portions of the drum core is thermally cured at a temperature greater than the melting point of the wax, thereby the wax in the resin composition is melted to provide lower viscosity to the resin composition so that the resin composition covers the entire surface of the winding.

* * * * *